US005982266A

United States Patent [19]

Sanford et al.

[11] Patent Number: 5,982,266

[45] Date of Patent: Nov. 9, 1999

[54] FUSE BLOCK-OUT DEVICE

[75] Inventors: Craig V. Sanford, Streator; James D. Hedenschoug, Braidwood; Frank J. Mlinar, Waukegan, all of Ill.

[73] Assignee: Commonwealth Edison Company, Chicago, Ill.

[21] Appl. No.: 09/163,278

[22] Filed: Sep. 29, 1998

[51] Int. Cl.[6] ..... H01H 85/22; B25B 33/00; B25B 27/14

[52] U.S. Cl. ..... 337/168; 81/3.8; 81/487; 361/835

[58] Field of Search ..... 337/168, 186, 337/205, 210, 211; 81/3.8, 487; 361/835, 833

[56] References Cited

U.S. PATENT DOCUMENTS

| | | | |
|---|---|---|---|
| 3,813,626 | 5/1974 | Cetola et al. . | |
| 4,094,212 | 6/1978 | Hyams et al. | 81/3.8 |
| 4,128,024 | 12/1978 | Hyams et al. | 81/3.8 |
| 4,333,701 | 6/1982 | Schnick . | |
| 4,385,282 | 5/1983 | Ahroni . | |
| 4,543,557 | 9/1985 | Schaefer . | |
| 4,669,794 | 6/1987 | Benda | 439/148 |
| 5,002,505 | 3/1991 | Jones et al. . | |
| 5,076,118 | 12/1991 | Lawson | 81/3.8 |
| 5,207,590 | 5/1993 | Benda | 439/148 |
| 5,240,435 | 8/1993 | Forbrook . | |
| 5,267,493 | 12/1993 | Yamagata et al. | 81/3.8 |
| 5,338,228 | 8/1994 | Wright, Jr. et al. . | |
| 5,384,559 | 1/1995 | Shamir . | |
| 5,556,305 | 9/1996 | Naegelin | 439/622 |
| 5,797,298 | 8/1998 | Grevel | 81/3.8 |

OTHER PUBLICATIONS

"UL 512 Standard For Fuseholders", Underwriters Laboratories Inc. (1993).

EMED Co., Inc. Catalog P32–C, Spring/Summer 1997, pp. 78P–80P.

"Lockout/Tagout, Confined Space And Hazard Communication Products" Catalog, Brady Signmark Division, 19 pages.

"Lockout/Tagout Confined Space And Hazard Communication Products," Customer Price List—effective Nov. 1, 1996, 8 pages.

Diagram showing Fuse Holder Device (1 page, 4 views).

*Primary Examiner*—Leo P. Picard
*Assistant Examiner*—Anatoly Vortman
*Attorney, Agent, or Firm*—Brinks Hofer Gilson & Lione

[57] ABSTRACT

An improved fuse block-out device is disclosed that includes a fuse block-out device that includes a first portion shaped to be received by a fuse block and a second portion shaped to securely engage a fuse. When a fuse is removed from the fuse block, the first portion of the fuse block-out device is inserted into the fuse block, and the removed fuse is inserted into the second portion of the fuse block-out device. In this way, the fuse block-out device reduces accidental electrical shock and prevents accidental replacement of the removed fuse. Because the removed fuse is securely engaged, the fuse block-out device controls the location of the removed fuse.

26 Claims, 3 Drawing Sheets

FUSE BLOCK-OUT DEVICE

BACKGROUND

In many electrical circuits, a fuse block 500 (see FIG. 5) is installed between a power panel and an electrical device. First and second fuse clips 510, 520 of the fuse block 500 are designed to engage with first and second conductive end caps of a fuse. When the fuse clips engage a fuse, electricity flows from the power panel to the device through the fuse and fuse clips. To prevent electricity from flowing to the device, the fuse can be removed from the fuse block. Once the fuse is removed, however, the exposed fuse clips create a potentially hazardous condition.

One way to reduce the likelihood of contact with the exposed fuse clips is to place a fuse block-out device (or "dummy fuse") in the exposed fuse clips. In addition to reducing accidental contact with the exposed fuse clips, a fuse block-out device also prevents accidental replacement of the removed fuse. One type of fuse block-out device that has been used is a bar of non-conductive material, such as nylon or Teflon™, shaped like a fuse. Another type of fuse block-out device is a non-conductive cylindrical member used to engage one, but not both, of the fuse clips of the fuse block. One problem associated with each of these fuse block-out devices is that the removed fuse is often misplaced.

To overcome this problem, some fuse block-out devices are designed for fuse storage. One such fuse block-out device is incorporated into a fuse remover. As with conventional fuse removers, the gripping end of this fuse remover can be used to remove a fuse from a fuse block. After the fuse is removed, the end portion of the handle of the fuse remover can be inserted between the fuse clips to act as a fuse block-out. Additionally, the removed fuse can be stored between the arms of the fuse remover to prevent the fuse from being misplaced. When the removed fuse is stored, it is held in a perpendicular arrangement with respect to adjacent fuses engaged in adjacent fuse blocks. This arrangement reduces accessibility to these adjacent fuses, making them difficult or impossible to insert or remove.

There is, therefore, a need for an improved fuse block-out device that will overcome the disadvantages described above.

SUMMARY

The present invention is defined by the following claims, and nothing in this section should be taken as a limitation on those claims.

By way of introduction, the preferred embodiments described below include a fuse block-out device that includes a first portion shaped to be received by a fuse block and a second portion shaped to securely engage a fuse. When a fuse is removed from the fuse block, the first portion of the fuse block-out device is inserted into the fuse block, and the removed fuse is inserted into the second portion of the fuse block-out device. In this way, the fuse block-out device reduces accidental electrical shock and prevents accidental replacement of the removed fuse. Because the removed fuse is securely engaged, the fuse block-out device controls the location of the removed fuse.

The preferred embodiments will now be described with reference to the attached drawings.

DETAILED DESCRIPTION OF THE PRESENTLY PREFERRED EMBODIMENTS

Figure 1:
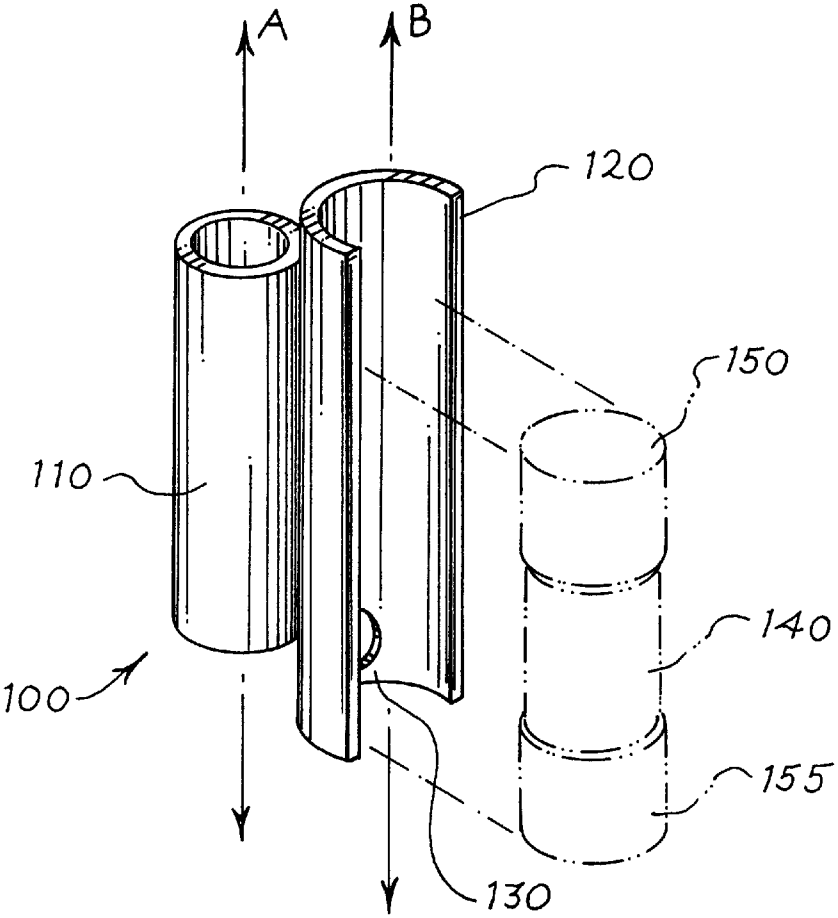
FIG. 1 is a perspective view of a fuse block-out device of a preferred embodiment.
Figure 5:
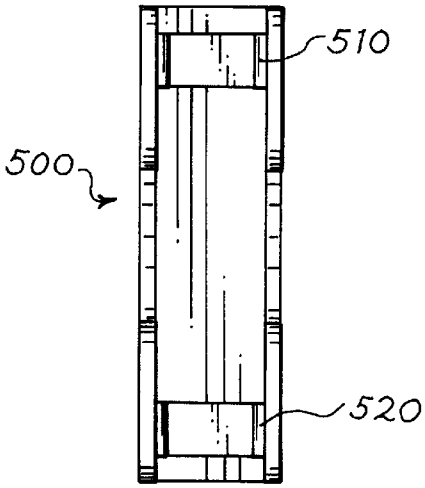
Fig. 5 (PRIOR ART)
FIG. 5 is a front view of a prior art fuse block.

Turning now to the drawings, FIG. 1 is a perspective view of a fuse block-out device 100 of a preferred embodiment. The fuse block-out device 100 comprises a substantially cylindrical first portion 110 shaped to be received by first and second fuse clips 510, 520 of a conventional fuse block 500 (FIG. 5) and a second portion 120 shaped to securely engage a fuse 140. The first and second portions 110, 120 each define a longitudinal axis (A and B, respectively) extending along its length. In this preferred embodiment, the longitudinal axis B of the second portion 120 is substantially parallel to the longitudinal axis A of the first portion 110 so that when a fuse is securely engaged with the second portion 120, it is held in a substantially parallel arrangement with the first portion 110. The second portion 120 also comprises a section 130 defining a hole.

Figure 4:
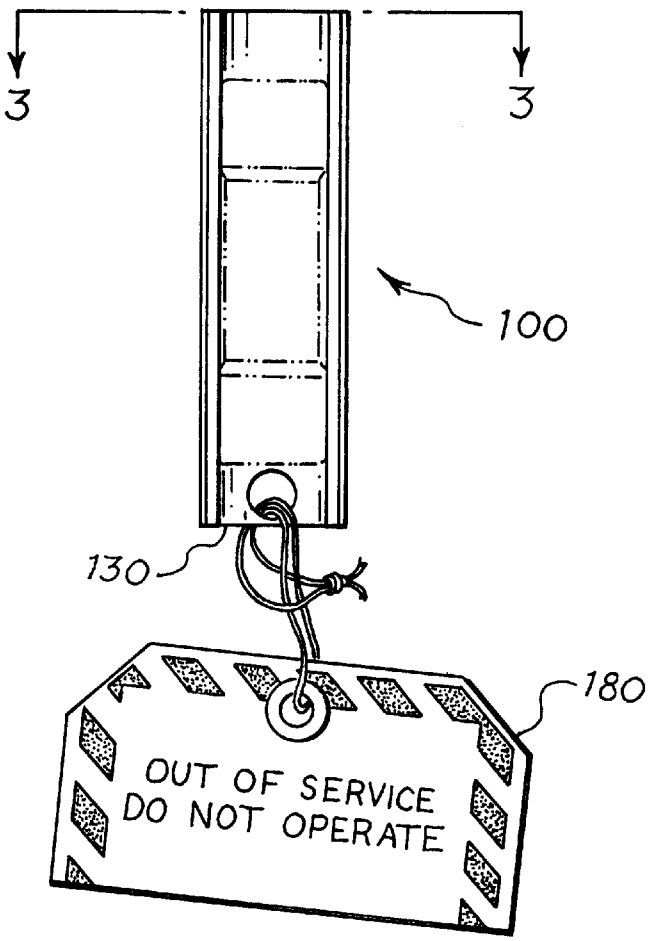
FIG. 4 is a front view of a fuse block-out device of a preferred embodiment.
Figure 2:
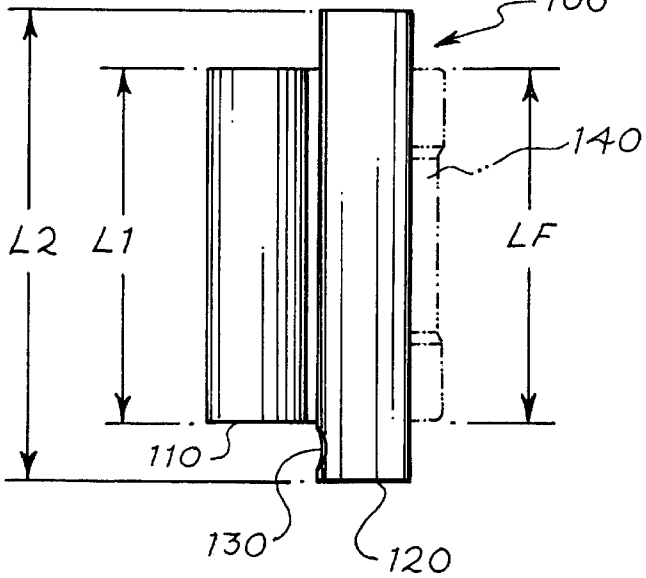
FIG. 2 is a side view of a fuse block-out device of a preferred embodiment.
Figure 3:
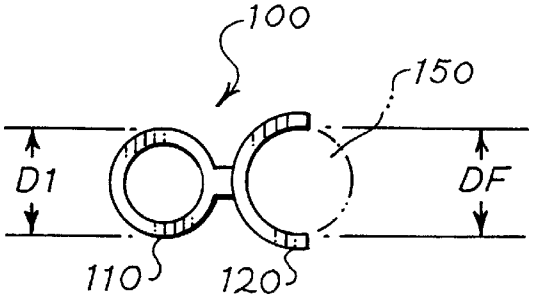
FIG. 3 is a sectional view of a fuse block-out device taken along line 3—3 of FIG. 4.

FIG. 2 is a side view of the fuse block-out device 100. As shown in FIG. 2, the longitudinal length L1 of the first portion 110 is less that the longitudinal length L2 of the second portion 120. Additionally, the longitudinal length L1 of the first portion 110 is substantially equal to the longitudinal length LF of the fuse 140, and the longitudinal length L2 of the second portion 120 is greater than the longitudinal length LF of the fuse 140. FIG. 3 a sectional view of the fuse block-out device 100 taken along line 3—3 of FIG. 4. As shown in FIG. 3, the diameter D1 of the first portion 110 is substantially equal to the diameter DF of the conductive end caps 150, 155 of the fuse 140. FIG. 3 also shows that the second portion 120 of this preferred embodiment securely engages the fuse 140 by engaging more than half of the circumference of the first and second conductive end caps 150, 155 of the fuse 140. In this way, the second portion 120 acts as a clip that not merely holds but securely engages the fuse 140 when snapped into the clip.

In operation, after the fuse 140 is removed from the fuse clips 510, 520 of a fuse block 500, the fuse 140 is snapped into the second portion 120 of the fuse-block out device 100 to securely hold the fuse 140, and the first portion 110 of the fuse block-out device 100 is engaged into the fuse clips 510, 520. With this arrangement, the fuse block-out device 100 occupies the space previously filled by the fuse 140 and, accordingly, reduces accidental contact with the exposed fuse clips and prevents accidental replacement of the removed fuse 140.

Unlike many of the devices described above in the Background section, this fuse block-out device 100 controls the location of the removed fuse 140 by securely engaging the remove fuse 140 in the second portion 120. Further, unlike the fuse remover/fuse block-out device described in the Background section, this fuse block-out device 100 stores the removed fuse 140 in a substantially parallel arrangement with respect to the first portion 110 and, accordingly, does not obstruct the insertion (or removal) of adjacent fuses into (or from) adjacent fuse blocks. Additionally, the lateral dimension of the second portion 120 is sized to allow accessibility to adjacent fuses when the first portion engages with a fuse block and also allows the fuse block-out device 100 to be removed with a conventional fuse remover.

As discussed above, the longitudinal length L2 of the second portion 120 is greater than the longitudinal length LF of the fuse 140. This extra length provides the advantage of adding insulation between the fuse clips 510, 520 of the fuse block 500 and the conductive end caps 150, 155 of the fuse 140, thereby reducing the likelihood of electrical contact between the fuse clips 510, 520 and the end caps 150, 155 of the fuse 140. Additionally, the extra length allows a section 130 of the second portion 120 to define a hole that can be used to place an "out of service" tag 180 on the fuse block-out device 100 (FIG. 4), as required by OSHA regulations in some environments.

Preferably, the first portion 110 is about 2.0 inches long, has an outer diameter of about 0.562 inches, and has an inner diameter of about 0.375 inches. The second portion 120 preferably is about 2.688 inches long, has an outer diameter of about 0.750 inches, and has an inner diameter of about 0.562 inches. The second portion 120 preferably extends about 0.344 inches on either side of the first portion 110 and is designed to securely engage about 0.186 inches more than half the circumference of the conductive end caps 150, 155 of the fuse 140 (about 0.093 inches on each side to form a distance of about 0.548 inches between the inner lateral ends of the second portion 120). The distance between the center of the circles defined by the first and second portions 110, 120 is preferably about 0.718 inches. Such a fuse block-out device would be suitable to securely engage a 9/16 inch diameter, 2.0 inch-long cartridge fuse. Additionally, it is preferred that the hole defined in section 130 is about 0.218 inches in diameter and has its center about 0.2 inches from the bottom of the second portion 120.

Because the fuse-block out device 100 is designed to be received by a fuse block, it is preferred that at least the first portion 110 be made of a non-conductive material. Preferably, the fuse-block out device 100 is made from red Cycolac® KJB ABS flame-retardant resin. It is further preferred that the fuse block-out device 100 be seismically qualified. As used herein, a fuse block-out device is "seismically qualified" when a fuse-block out device test sample passes Trentec Seismic Qualification Test Report 50101.8, Rev. 0, Dated Feb. 06, 1998 and Trentec Seismic Qualification Test Procedure 50101.8, Rev. 0, Dated Jan. 13, 1998 from Trentec, Inc. of Cincinnati, Ohio. As used herein, the term "fuse-block out device test sample" refers to a standard cartridge fuse holder that meets UL512 Standards having engaged therein a fuse-block out device holding a Buss Fuse No. NON-10 Class K5 fuse. If the fuse block-out device is not seismically qualified, it is possible that, due to a seismic event such as an earthquake, the secured fuse and/or the fuse block-out device itself can be shaken loose. These loose components can strike and activate/deactivate nearby switches, creating an unacceptable risk in many power environments such as nuclear power facilities.

Figure 6:
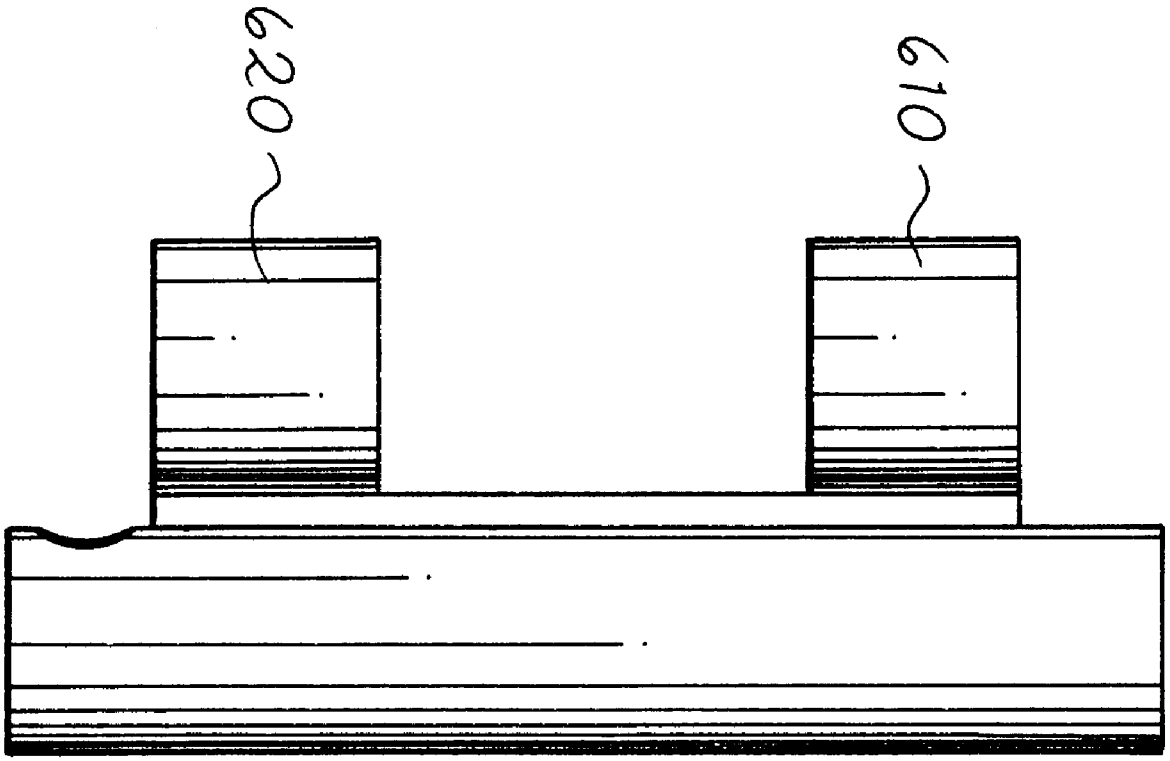
FIG. 6 is a side view of a fuse block-out device of an alternate embodiment.

There are several alternatives to the presently preferred embodiments described above. In one alternative shown in FIG. 6, instead of the first portion being shaped like a fuse, the first portion comprises two substantially cylindrical members 610, 620 that are shaped to be received by the fuse clips of a fuse block. In another alternative, the first portion comprises a single, substantially-cylindrical member shaped to be received by one, but not both, of the fuse clips of a fuse block. In yet another alternative, the first portion is non-cylindrical (e.g., flat).

While the second portion described above engages more that half of the circumference of both the first and second conductive end caps of the fuse, the second portion can alternatively engage more than half of the circumference of one, but not both, of the conductive end caps. In another alternative, the second portion engages the body of the fuse rather that the conductive end caps. In yet another alternative, the second portion securely engages the fuse but does not engage more than half of the circumference of the end cap, such as when the second portion grips diametrically opposite portions of the end cap. It should be apparent that any of the alternatives discussed above can be used in combination with one or more of the other alternatives. For example, the second portion can engage both end caps of a fuse to position the fuse in a non-parallel arrangement with respect to the longitudinal axis A of the first portion, or the second portion can engage one, but not both, of the end caps of the fuse to position the fuse in a parallel arrangement with respect to the longitudinal axis A of the first portion.

Of course, many changes and modifications (including, but not limited to, dimensions, sizes, shapes, orientation, etc.) are possible to the preferred embodiments described above. For example, the length L2 of the second portion 120 can be equal to the length LF of the fuse 140. With this alternative, the section 130 defining a hole has been removed. Although the fuse block-out device is operational without the hole, if a hole is still desired, a lip with a hole defined therein can be added around either or both sides of the second portion. Because the lateral dimension of the second portion is increased in this alternative embodiment, the accessibility of adjacent fuses may be reduced when the fuse-block out device is received by a fuse block. Additionally, with this alternative, the fuse block-out device may be more difficult to remove with a conventional fuse remover.

It is important to note that while the preferred embodiments have been described above with regard to a cartridge fuse, other sizes and types of fuses can be used with appropriate modifications to the fuse-block out device.

The foregoing detailed description has described only a few of the many forms that this invention can take. For this reason it is intended that this detailed description be regarded as an illustration and not as a limitation of the invention. It is only the following claims, including all equivalents, that are intended to define the scope of this invention.

What is claimed is:

1. A fuse block-out device comprising:

a non-conductive first portion shaped to be received by a fuse clip of a fuse block; and a second portion coupled with the first portion and shaped to securely engage a fuse comprising first and second conductive end caps;

wherein the first portion and said fuse comprise respective longitudinal lengths, wherein the first portion and said end caps comprise respective diameters, wherein the longitudinal length of the first portion is substantially equal to the longitudinal length of said fuse, and wherein the diameter of the first portion along its longitudinal length is substantially equal to the diameter of said end caps.

2. A fuse block-out device comprising:

a non-conductive first portion shaped to be received by a fuse clip of a fuse block; and a second portion coupled with the first portion and shaped to securely engage a fuse comprising first and second conductive end caps comprising respective circumferences; the second portion being shaped to securely engage more than half of said circumference of said first and second conductive end caps.

3. A fuse block-out device comprising:

a non-conductive first portion shaped to be received by a fuse clip of a fuse block, the first portion defining a longitudinal axis extending along its length; and a second portion coupled with the first portion and shaped to securely engage a fuse comprising first and second conductive end caps comprising respective circumferences; the second portion being shaped to securely engage more than half of said circumference of at least one of said first and second conductive end caps;

wherein the second portion defines a longitudinal axis extending along its length, the longitudinal axis of the second portion being substantially parallel to the longitudinal axis of the first portion.

4. A fuse block-out device comprising:

a substantially cylindrical non-conductive first portion shaped to be received by a fuse clip of a fuse block; and a second portion coupled with the first portion and shaped to securely engage a fuse comprising first and second conductive end caps comprising respective circumferences; the second portion being shaped to securely engage more than half of said circumference of at least one of said first and second conductive end caps.

5. The invention of claim 2, 3, or 4, wherein the first portion and said fuse comprise respective longitudinal lengths and diameters, and wherein the longitudinal length and diameter of the first portion are substantially equal to the longitudinal length and diameter respectively of said fuse.

6. The invention of claim 2, 3, or 4, wherein the first portion is shaped to be received by only one of a first and second fuse clip of a fuse block.

7. The invention of claim 2 or 3, wherein the first portion comprises a substantially cylindrical member shaped to be received by one of a first and second fuse clip of a fuse block.

8. The invention of claim 2, 3, or 4, wherein the first portion is shaped to be received by both a first and second fuse clip of a fuse block.

9. The invention of claim 2, 3, or 4, wherein the first portion comprises a first substantially cylindrical member and a second substantially cylindrical member shaped to be received by a first and second fuse clip respectively of a fuse block.

10. The invention of claim 3 or 5, wherein the second portion is shaped to securely engage a fuse comprising first and second conductive end caps comprising respective circumferences; the second portion being shaped to securely engage more than half of said circumference of said first and second conductive end caps.

11. The invention of claim 2 or 4, wherein the first portion defines a longitudinal axis extending along its length and wherein the second portion defines a longitudinal axis extending along its length, the longitudinal axis of the second portion being substantially parallel to the longitudinal axis of the first portion.

12. The invention of claim 1, 2, 3, or 4, wherein the second portion and said fuse comprise respective longitudinal lengths and the longitudinal length of the second portion is greater than said longitudinal length of said fuse.

13. The invention of claim 1, 2, 3, or 4, wherein the first portion and the second portion comprise longitudinal lengths and wherein the longitudinal length of the second portion is greater than the longitudinal length of the first portion.

14. The invention of claim 1, 2, 3, or 4, wherein the second portion comprises a lateral dimension, and wherein the lateral dimension of the second portion is sized to allow accessibility of adjacent fuses when the first portion engages with said fuse clip of said fuse block.

15. The invention of claim 1, 2, 3, or 4, wherein the second portion comprises a lateral dimension, and wherein the lateral dimension of the second portion is sized to allow accessibility of adjacent fuses when the first portion engages with said fuse clip of said fuse block and when the second portion securely engage said fuse.

16. The invention of claim 1, 2, 3, or 4, wherein the second portion comprises a section defining a hole.

17. The invention of claim 1, 2, 3, or 4, wherein the fuse block-out device is seismically qualified.

18. The invention of claims 1, 3, or 4, wherein the first portion comprises a length of about 2.0 inches, and wherein the second portion comprises a length of about 2.688 inches.

19. The invention of claims 1, 3, or 4, wherein the second portion comprises a section defining a hole comprising a diameter of about 0.218 inches.

20. The invention of claims 1, 3, or 4, wherein the first and second portion comprise an ABS flame-retardant resin.

21. A fuse block-out device comprising:

a non-conductive first portion shaped to be received by a fuse clip of a fuse block; and a second portion coupled with the first portion and shaped to securely engage a fuse;

wherein the first portion and said fuse comprise respective longitudinal lengths and diameters, and wherein the longitudinal length and diameter of the first portion are substantially equal to the longitudinal length and diameter respectively of said fuse;

wherein the second portion is shaped to securely engage a fuse comprising first and second conductive end caps comprising respective circumferences; the second portion being shaped to securely engage more than half of said circumference of at least one of said first and second conductive end caps.

22. A fuse block-out device comprising:

a non-conductive first portion shaped to be received by a fuse clip of a fuse block; and a second portion coupled with the first portion and shaped to securely engage a fuse;

wherein the first portion and said fuse comprise respective longitudinal lengths and diameters, and wherein the longitudinal length and diameter of the first portion are substantially equal to the longitudinal length and diameter respectively of said fuse;

wherein the second portion is shaped to securely engage a fuse comprising first and second conductive end caps comprising respective circumferences; the second portion being shaped to securely engage more than half of said circumference of said first and second conductive end caps.

23. A fuse block-out device comprising:

a non-conductive first portion shaped to be received by a fuse clip of a fuse block; and a second portion coupled with the first portion and shaped to securely engage a fuse;

wherein the first portion and said fuse comprise respective longitudinal lengths and diameters, and wherein the longitudinal length and diameter of the first portion are substantially equal to the longitudinal length and diameter respectively of said fuse;

wherein the first portion defines a longitudinal axis extending along its length and wherein the second portion defines a longitudinal axis extending along its length, the longitudinal axis of the second portion being substantially parallel to the longitudinal axis of the first portion.

24. A fuse block-out device comprising:

a non-conductive first portion comprising a first substantially cylindrical member shaped to be received by a first fuse clip of a fuse block and a second substantially cylindrical member shaped to be received by a second fuse clip of a fuse block; and a second portion coupled with the first portion and shaped to securely engage a fuse;

wherein the second portion is shaped to securely engage a fuse comprising first and second conductive end caps comprising respective circumferences; the second portion being shaped to securely engage more than half of said circumference of at least one of said first and second conductive end caps.

25. A fuse block-out device comprising:

a non-conductive first portion comprising a first substantially cylindrical member shaped to be received by a first fuse clip of a fuse block and a second substantially cylindrical member shaped to be received by a second fuse clip of a fuse block; and a second portion coupled with the first portion and shaped to securely engage a fuse;

wherein the second portion is shaped to securely engage a fuse comprising first and second conductive end caps comprising respective circumferences; the second portion being shaped to securely engage more than half of said circumference of said first and second conductive end caps.

26. A fuse block-out device comprising:

a non-conductive first portion comprising a first substantially cylindrical member shaped to be received by a first fuse clip of a fuse block and a second substantially cylindrical member shaped to be received by a second fuse clip of a fuse block; and a second portion coupled with the first portion and shaped to securely engage a fuse;

wherein the first portion defines a longitudinal axis extending along its length and wherein the second portion defines a longitudinal axis extending along its length, the longitudinal axis of the second portion being substantially parallel to the longitudinal axis of the first portion.

* * * * *

UNITED STATES PATENT AND TRADEMARK OFFICE

CERTIFICATE OF CORRECTION

PATENT NO. : 5,982,266
DATED : November 9, 1999
INVENTOR(S) : Craig V. Sanford et al.

It is certified that error appears in the above-identified patent and that said Letters Patent is hereby corrected as shown below:

CLAIMS

Claim 10, line 1, delete "3 or 5" and substitute -- 3 or 4 -- in its place.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*